United States Patent [19]

Egger

[11] 4,243,281

[45] Jan. 6, 1981

[54] TYPEWRITER CABINET

[76] Inventor: Paul R. Egger, 10616 Campana Dr., Sun City, Ariz. 85351

[21] Appl. No.: 68,941

[22] Filed: Aug. 23, 1979

[51] Int. Cl.[3] ..... A47B 21/00; A47B 81/00

[52] U.S. Cl. ..... 312/208; 312/21; 312/23; 312/26

[58] Field of Search ..... 312/27, 30, 22, 21, 312/208, 23, 24, 271, 276, 25, 28, 26

[56] References Cited

U.S. PATENT DOCUMENTS

| | | | |
|---|---|---|---|
| 299,687 | 6/1884 | Seller | 312/25 |
| 1,838,087 | 12/1931 | Frankel | 312/27 X |
| 2,919,966 | 1/1960 | Preston | 312/27 |
| 3,071,424 | 1/1963 | Butter | 312/27 |
| 3,221,803 | 12/1965 | Lambert | 312/271 X |

FOREIGN PATENT DOCUMENTS

| | | | |
|---|---|---|---|
| 576906 | 5/1924 | France | 312/27 |
| 588023 | 1/1925 | France | 312/27 |

*Primary Examiner*—James T. McCall
*Attorney, Agent, or Firm*—Cahill, Sutton & Thomas

[57] ABSTRACT

A typewriter cabinet includes a fixed bottom, fixed sidewalls and a rear wall extending vertically from the base. A moveable front wall is hingeably connected to the base. A pair of hinged top plates serve as a top for the typewriter cabinet when the typewriter is recessed, but swing outward and serve as part of the top when the typewriter is raised and in use. A moveable shelf for holding the typewriter includes a rear backrest which supports the typewriter when it is recessed. The moveable shelf is hinged to the top of the moveable front wall and folds against the inside surface of the moveable front wall. A rotatable pivot plate has three pivot points. The first pivot point is connected to a connecting point on an edge of the moveable shelf. The second pivot is connected to a pin extending from the sidewalls. The third point is connected by means of a spring to an anchor point on the base. Tension in the spring causes the pivot plate to rotate when the top portion of the moveable front is pulled forward, causing the moveable shelf to pivot, lifting the typewriter from a recessed position to a raised, stable horizontal position.

12 Claims, 10 Drawing Figures

TYPEWRITER CABINET

BACKGROUND OF THE INVENTION

1. Field of the Invention

The invention relates to typewriter cabinets, and more particularly typewriter cabinets which conceal a typewriter when it is not being used and allow the typewriter to be quickly raised to a level position for use.

2. Description of the Prior Art

Typewriters are usually very heavy, expensive machines which in many cases are only occasionally used, especially when they are used in a home, rather than at a commercial establishment. It is therefore highly desirable that storage space be available which adequately protects a typewriter when it is not in use. Due to the heavy weight and high degree of fragility of an ordinary typewriter, it is also desirable that it be readily and easily moveable from such a storage space to a suitable location for use by a typist. Since lifting of a typewriter tends to produce stresses on delicate, precision mechanical components of the machine, it is desirable that the typewriter be stored, when not in use, from a location from which it can be retrieved and moved to a suitable use location without manually lifting the typewriter. This would avoid possible damage to the typewriter due to internal stresses or dropping of the typewriter and would also avoid the possibility of strained muscles or similar injury to the person lifting the typewriter.

Accordingly, it is an object of the invention to provide a typewriter cabinet having a receding typewriter support which maintains the typewriter in a protected location when the typewriter is not in use and which moves a typewriter into a raised, level, stable use position without requiring manual lifting the typewriter.

One solution to the problem of storing typewriters has been simply to provide wood or metal typewriter stands which hold a typewriter at a convenient height for use by a typist. When the typewriter is not in use, a cloth or flexible plastic cover is placed over the typewriter. However, fabric or flexible plastic covers are rather unattractive and do not provide any significant protection to the typewriter other than to keep dust off of it. Further, the support surface cannot be used for any other purpose even when the typewriter is not in use.

Accordingly, another object of the invention is to provide an attractive typewriter cabinet which stores a typewriter in a protected, hidden interior location of the cabinet and which rapidly and automatically lifts the typewriter into a raised, level position with a minimal amount of exertion by a person who wishes to use the typewriter.

A variety of cabinets and desks having moveable shelves for supporting typewriters have been proposed. However, all of them have suffered from various shortcomings, including the shortcomings of being large and bulky, of requiring that a typewriter be bolted to a moveable support surface, of having hinging mechanisms and guide mechanisms which are complex, of having tendencies to bind, of being generally unreliable, and of requiring an undue amount of effort by the user to lift the typewriters from hidden locations to a use location.

Accordingly, another object of the invention is to provide a compact, low cost typewriter cabinet having a simple, reliable mechanism for raising a typewriter from a recessed position to a raised, level use position with minimal effort by the user.

A novelty search directed to the present invention uncovered the following patents, which are believed to be illustrative of the state of the art: U.S. Pat. Nos. 410,470; 654,974; 1,364,917; 1,398,618; 1,754,303; 1,994,742; 2,125,777; 3,537,110 and 3,707,316.

SUMMARY OF THE INVENTION

Briefly described, and in accordance with one embodiment thereof, the invention provides a compact typewriter cabinet which includes a base having a fixed back wall and two fixed sidewalls extending vertically therefrom. A moveable front wall has its bottom edge hingeably connected to the base, and swings outwardly from the front of the cabinet. A moveable shelf having a rear backrest extending approximately vertically from the upper surface of the moveable shelf is hinged at its forward edge to the upper inner edge of the moveable front wall. The moveable shelf supports a typewriter which loosely rests on the upper surface of the moveable shelf. The backrest extends from the upper surface at an acute angle somewhat less than ninety degrees in order to force the bottom of the typewriter against the upper surface of the moveable shelf when the moveable shelf is folded against the inner surface of the moveable front wall (i.e., when the moveable shelf is in the recessed position). The moveable front wall extends approximately vertically from the base when the typewriter is recessed, the moveable front wall shelf then being folded against the inner surface of the front wall. First and second rotating pivot plates each have corresponding first, second, and third pivot points thereof. The first, second, and third pivot points of each pivot plate form a triangle. Each first pivot point is pivotally connected to a respective opposed fixed point of the inner surface of a respective one of the sidewalls, so that the first and second pivot plates rotate about their respective first pivot points. The second pivot point of each rotatable pivot plate is pivotally connected to a connecting point on a respective side edge of the moveable shelf. The third pivot point of each rotating pivot plate is connected to a tension spring. The opposite end of the tension springs is anchored to the base. The moveable front wall has a large opening therein for accommodating the knees of a typist when the moveable shelf is in a raised, horizontal position. When the typewriter is in its recessed position, the bottom surface of the support shelf covers the opening in the moveable front wall. In this configuration, the tension spring lies to the rear of the first pivot point of each rotatable pivot plate, thereby urging the pivot plate to rotate in such a direction as to raise the first pivot point. However, the tension of the springs and the weight of the typewriter are such that the moveable shelf remains in its lowered position, folded against the inner surface of the moveable front wall. If the moveable front wall is pulled forward, the tension of the spring assists upward pivoting of the movable shelf caused by rotation of the pivot plates. As the pivot plate continues such rotation, the front wall extends further outward until the shelf reaches a level configuration. As the pivot plates continue to rotate due to the downward force exerted by the springs on the respective third pivot points, the rear portion of the moveable shelf is raised past the top of a circular arc traced by the respective second points, and comes to rest at a point rearward of the top of the circular path traced by the respective second points. A typewriter supported by the moveable shelf is then in a level, stable position and is ready for use. The typewriter is returned to the recessed position by first pulling forward on a handle mounted on the upper front surface of the front wall, causing the pivot plates to rotate in a direction opposite to their direction of rotation during raising of the moveable shelf. The momentum of the shelf and typewriter thereon cause the pivot plates to rotate, first slightly raising moveable shelf and then lowering it. When the handle has traveled to its maximum outward position. the user then pushes inward on the handle. The moveable shelf then moves downward, and folds against the inner surface of the moveable front wall. A pair of opposed hinged top surfaces attached to the hingeable attached to the upper sidewalls provide a cover for the typewriter cabinet. A stationery cabinet is supported within the lower portion of the interior volume of the cabinet. The front of the stationery cabinet is aligned with the lowered moveable shelf, covering the opening in the moveable front wall.

DESCRIPTION OF THE INVENTION

Figure 1:
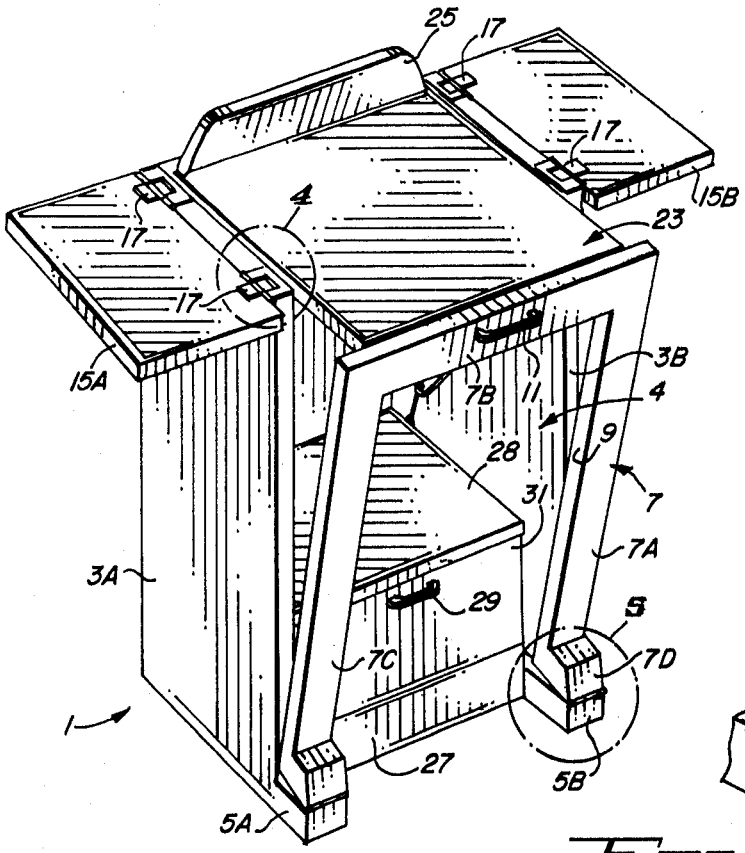
FIG. 1 is a perspective view showing the top and front surfaces of the typewriter cabinet of the invention with a moveable shelf in a raised, level position.
Figure 6:
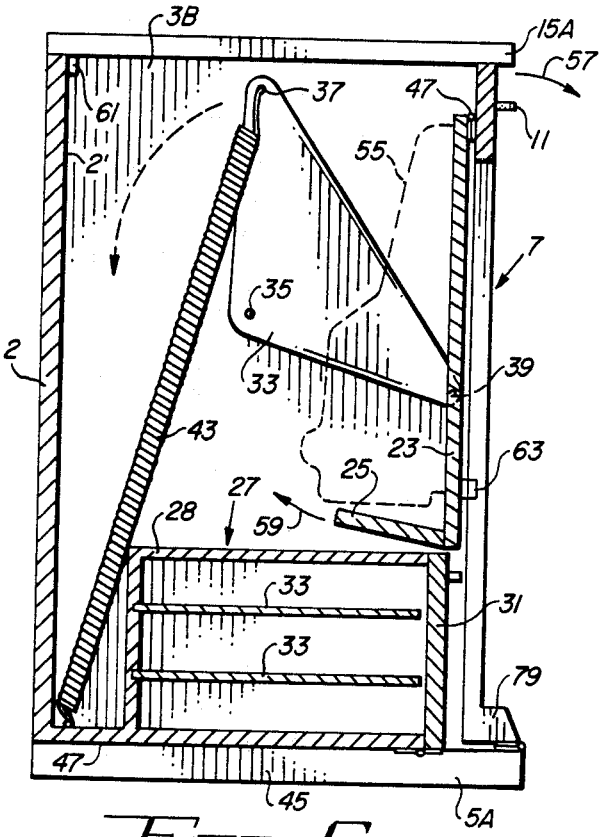
FIG. 6 is a section view taken along section line 6—6 of FIG. 2.

Referring now to the drawings, particularly to FIGS. 1 and 6, typewriter cabinet 1 includes a base 45 and two sidewalls 3A and 3B and a rear wall 2 rigidly attached to base 45. Sides 3A and 3B and rear wall 2 enclose interior volume 4. A floor 47 rests on base 45, as shown in FIG. 6.

Figure 5:
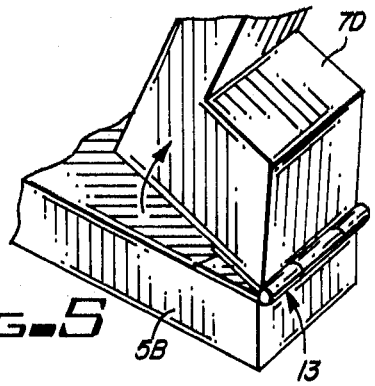
FIG. 5 is an expanded view of detail 5 of FIG. 1.

The foremost portions of base 45 include two extensions 5A and 5B. Moveable front wall 7 is hingeably attached to extensions 5A and 5B, as indicated in FIG. 5, which is an enlarged perspective view of detail 5 of FIG. 1.

More specifically, front wall 7 includes two upright side sections 7A and 7C connected by a top section 7B. A handle 11 is centrally connected to horizontal number 7B. A foot 7D is disposed at the bottom of each of the upright sides 7A and 7C, as shown in FIG. 5. A hinge 13 connects the lower front edge of foot 7D to the upper front edge of foot 5B. Upright portions 7A and 7C of moveable front wall 7 and horizontal member 7B thereof frame an opening 9, allowing the knees of a typist seated in front of typewriter cabinet 1 to conveniently extend underneath horizontal number 7B.

Figure 4:
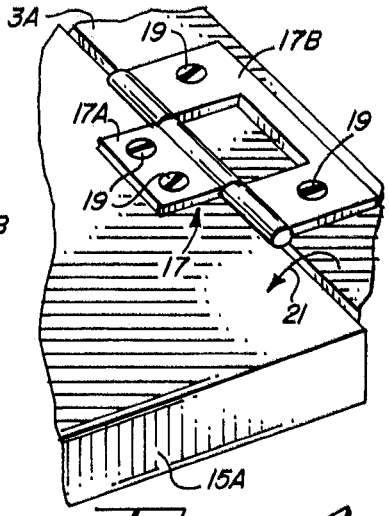
FIG. 4 is an expanded view of detail 4 of FIG. 1.

Typewriter cabinet 1 includes a pair of opposed side wings 15A and 15B hingeably connected by means of a plurality of hinges 17 to the upper edges of sidewalls 3A and 3B, respectively. The hinge connection 17, designated as detail 4 in FIG. 1, is shown in an enlarged view in FIG. 4, wherein hinge 17 includes two hinged leaves 17A and 17B connected by means of screws 19 to the upper edges of sidewalls 3A and 3B, respectively.

Moveable typewriter support shelf 23 is shown in its raised configuration in FIG. 1. A backstop 25 extends upwardly from the upper surface of moveable shelf 23, which is hingeably connected to cross member 7B of front wall 7 by means of hinge 47, as shown in FIG. 6.

Still referring to FIGS. 1 and 6, a stationery box 27 rests on floor 47. Stationery box 27 has a front door 31 having a handle 29. When door 31, which is hingeably attached at its bottom edge to floor 47, is swung outward, two interior shelves 33 bounding three storage compartments are exposed. Typing paper and other typing accessories can be conveniently stored in the three storage compartments.

Figure 2:
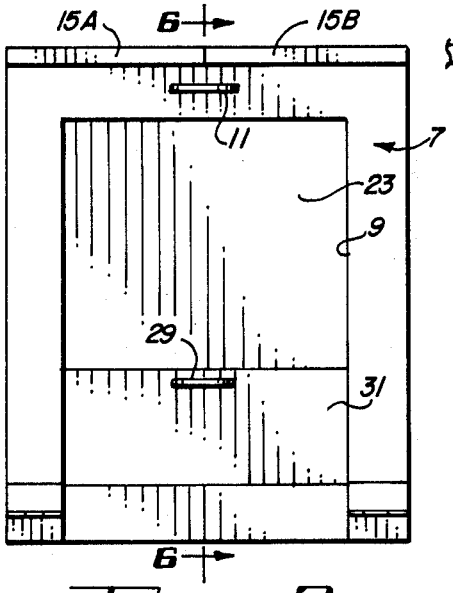
FIG. 2 is a front view of the typewriter cabinet of FIG. 1 with the moveable shelf in a lowered position.

As shown in FIG. 2, side wings 15A and 15B can be swung inward to cover interior volume 4 when typewriter support shelf 23 is lowered to the configuration shown in the section view of FIG. 6.

As can be seen in the section view of FIG. 6, the force due to the weight of typewriter 55 and the force due to leverage caused by the interaction of pivot plate 33 (subsequently described) together press the undersurface of moveable shelf 39 against the inner surface of moveable front 7. Front door 31 of stationery box 27 is aligned with moveable shelf 23 when it is in its lowered configuration, as shown in FIG. 6. Thus, opening 9 of moveable front wall 7 is completely covered by door 31 and moveable shelf 23 when the typewriter is stored. The undersurface of moveable shelf 23 and the outer surface of door 31 can be covered with attractive veneer or wood finish. The outer surface of frame-like moveable front wall 7 likewise can be made of an attractive finished material, as can the other exterior surfaces of typewriter cabinet 1.

Referring now to FIG. 6, pivot plate 33 includes three pivot points 35, 37 and 39. Pivot plate 33 is connected by means of a bolt or pin or the like to sidewall 3B at pivot point 35. Pivot plate 33 is connected to an edge of moveable shelf 23 by means of a pivot pin 39. Point 37 of pivot plate 33 is attached to one end of a long coil spring 43. The other end of coil spring 43 is anchored to bottom of floor 47 adjacent rear wall 2.

Thus, coil spring 43 continuously exerts a force on pivot plate 33, tending to rotate pivot plate 33 in the direction indicated by arrow 53.

In order to raise moveable shelf 23 (and typewriter 55), a user simply opens side wings 15A and 15B from the configuration shown in FIG. 2 to the configuration shown in FIG. 1 and pulls handle 11 outward in the direction indicated by arrow 57 in FIG. 6. This swings moveable front wall 7 outward in the direction indicated by arrow 57.

Since moveable shelf 39 is pivotally connected to pivot plate 33 at point 39, moveable shelf begins to pivot about hinge 47 in the direction indicated by arrow 59 in FIG. 6. The further moveable shelf 39 pivots in the direction indicated by arrow 59, the more upward leverage is provided by pivot plate 33 on pivot point 39, adding to the upward force on moveable shelf 39 created by the outward force resulting from above mentioned outward pulling of handle 11.

Figure 3:
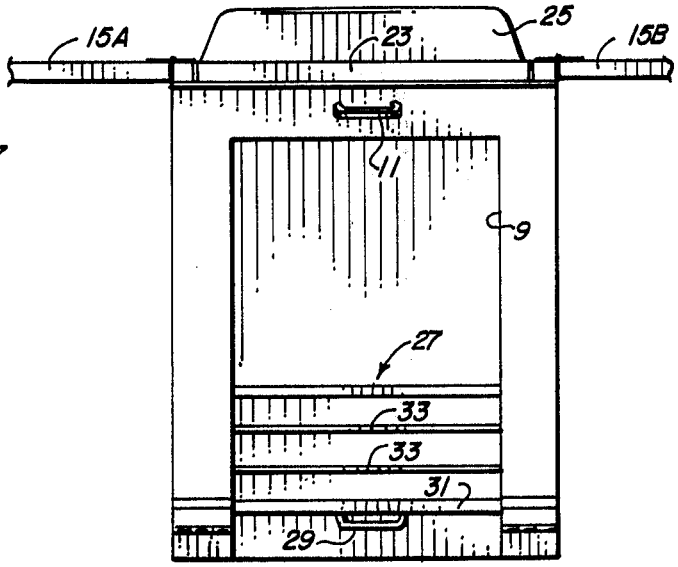
FIG. 3 is a front view of the typewriter cabinet of FIG. 1 with the moveable shelf raised, and a front door of an interior stationery cabinet lowered.

The operation of raising typewriter 55 from the stored position shown in FIG. 6 to the raised position shown in FIGS. 1 and 3 is best explained with reference to FIGS. 7A–7D. (For clarity of the illustration, the typewriter has been omitted in FIGS. 7A–7D.)

Figure 7A:
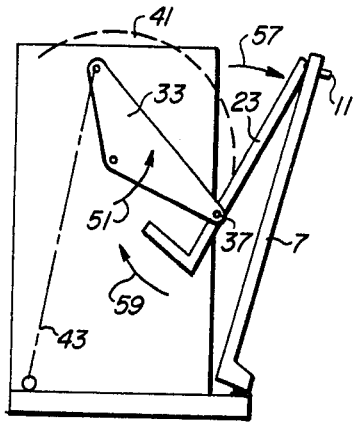
FIGS. 7A–7D are partial sectional drawings useful in illustrating the operation of the typewriter cabiner of FIG. 1.

Referring now to FIG. 7A, moveable front 7 has been pulled outward in the direction indicated by arrow 57. The force produced on pivot point 37 by coil spring 43 rotates pivot plate 33 in the direction indicated by arrow 51 to the extent permitted by the counterforce produced on pivot point 39 by moveable arm 23.

As pivot plate 33 rotates, pivot point 37 traces out a circular arc which is indicated by dotted line 41.

Figure 7B:
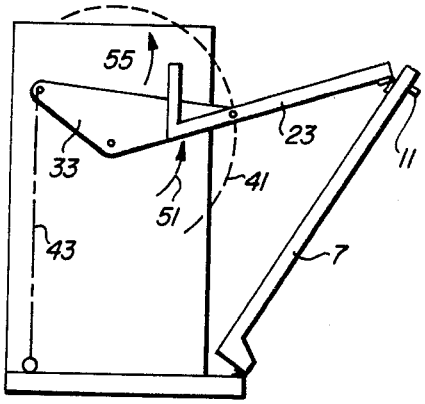
Figure 7C:
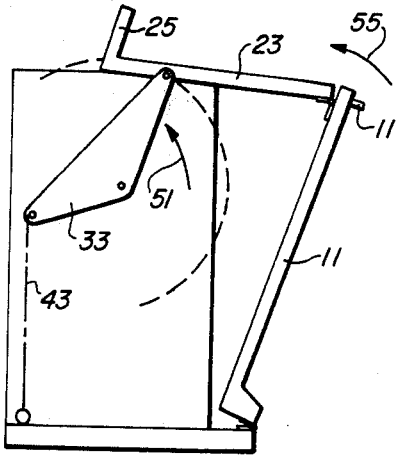

Referring now to FIG. 7B, the forces produced by coil spring 43 and by the outward force on handle 11 have combined to rotate pivot plate 33 to the configuration shown in FIG. 7B, thereby raising moveable shelf 23 and the typewriter thereon (not shown) to a nearly level position. At this point, moveable front 7 has been pulled as far outward as possible. The upward momentum of moveable shelf 23 and typewriter 55 and the upward force produced on point 39 by pivot plate 33 cause moveable shelf 23 to continue to move upward in the direction indicated by arrow 55 in FIG. 7B.

At this point, the user begins pushing inward on handle 11, rather than pulling it outward. The combined forces, including the inward force on handle 11 and the rotational force produced on pivot plate 33 by coil spring 43, cause moveable shelf 23 and moveable front wall 7 to move in the direction indicated by arrow 55 in FIG. 7C. At this point, moveable shelf 23 has been raised above the previously mentioned level position.

Figure 7D:
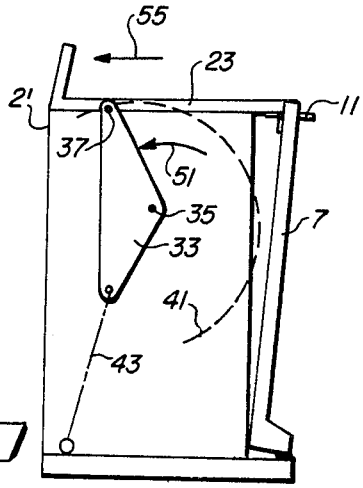

Referring now to FIG. 7D, pivot plate 33 continues rotating in the direction indicated by arrow 51, causing moveable plate 41 to move rearward in the direction indicated by arrow 55 until the rear end of moveable shelf 23 abuts the rigid inside surface 2' of rear wall 2. At this point, moveable shelf 23 is perfectly level. Further, moveable shelf 23 is completely stable, since it has "fallen" into a stable position from the top of arc 41. The downward force produced by the weight of moveable shelf 23 and typewriter 55 produces a downward force on pivot point 37. Since pivot point 37 is located to the left of pivot point 35 in FIG. 7D, this force tends to rotate pivot plate 33 in the direction indicated by arrow 51, producing a continuous rearward force on moveable shelf 23 in the direction indicated by arrow 55. Thus, there is no danger that a slight forward force applied to the typewriter or to moveable shelf 23 will cause moveable shelf 23 to move forward and fall back into the recessed configuration shown in FIG. 6.

The operation of lowering moveable shelf 23 and typewriter 55 from the configuration shown in FIG. 7D to the configuration shown in FIG. 6 is exactly the reverse of the operation previously described. To lower moveable shelf 23 and typewriter 55, the operator merely pulls outward on handle 11, causing pivot plate 33 to rotate clockwise. When moveable shelf 23 attains the configuration shown in FIG. 7B the operator reverses the direction of the force applied to handle 11, and begins gently pushing inward on handle 11. The downward momentum of typewriter 55 and moveable shelf 23 causes moveable shelf 23 to be lowered into the partially recessed configuration shown in FIG. 7A and finally to the completely recessed configuration shown in FIG. 6.

The tension in coil spring 43 can be selected to match to the combined weights of typewriter 55 and moveable shelf 23, so that a very smooth operation of raising and lowering the typewriter and moveable shelf is achieved.

In order to avoid possible mechanical shock to the typewriter caused by abrupt stopping of moveable shelf 23 during the above described operations, a plurality of shock absorbers or bumper pads 61 and 63 can be disposed at the upper inside edge of rear wall 2 and along the inside surface edges of moveable front wall 7, as indicated in FIG. 6. These cushions absorb any shock which may occur as a result of excessive speed and momentum produced during the raising or lowering of typewriter 55 and moveable shelf 23.

While the invention has been described with reference to a particular embodiment thereof, those skilled in the art can readily provide modifications which are within the spirit and scope of the invention, which is intended to be limited only as indicated in the appended claims. For example, various alter spring biasing arrangements than the one shown could be used to bias lever arm connected to points 35 and 39. Alternately, a motorized apparatus could be employed to turn such a lever arm to effect raising and lowering of moveable shelf 23 in response to pressing a control button.

I claim:

1. A cabinet for supporting a typewriter, said cabinet comprising in combination:

(a) a wall partially enclosing an interior volume of said cabinet;

(b) base means for supporting said wall;

(c) front means pivotally connected to said base means, said front means having an upper edge;

(d) support means for supporting the typewriter in a retracted position and in a raised, level position, said support means having a front edge pivotally connected to the upper edge of said front means said support means having a first connecting point spaced from said front edge;

(e) arm means pivotally connected to the first connecting point for guiding the first connecting point through an arcuate path during raising and lowering of said support means, said arm means having a first pivot point pivotally connected to a first fixed point within the interior volume, said arm means also having a second pivot point spaced from the first pivot point, the second pivot point being pivotally connected to the first connecting point of said support means, the second pivot point being located substantially below and forward of the first fixed point when said support means is in the retracted position, the second pivot point being located substantially above and rearward of the first fixed point when said support means is in the raised, level position; and (f) means for urging rotating of said arm means as said support means moves between the retracted position and the raised, level position.

2. The cabinet of claim 1 wherein said wall includes first and second rectangular sidewalls extending vertically from said base means and a rectangular rear wall extending from said base means and attached to said first and second sidewalls.

3. The cabinet of claim 2 wherein said front means includes a rectangular front wall having an opening for accommodating the knees of a typist seated before said cabinet, said front means including a lower edge, said cabinet further including first hinge means for pivotally connecting the lower edge of the front means to said base means.

4. The cabinet of claim 3 wherein said support means includes a flat, rectangular moveable shelf having an upper surface for supporting the typewriter and also having a lower surface, said shelf having a front edge hingeably connected to the upper edge of said front wall.

5. The cabinet of claim 4 further including backstop means extending outward from the upper surface of said shelf at an acute angle for engaging the back of a typewriter, said acute angle being selected to urge the bottom of the typewriter against said upper surface when said shelf is in the retracted position.

6. The cabinet of claim 4 wherein said arm means includes a rotatable pivot plate, said first and second pivot points being disposed in said pivot plate, said pivot plate further including a third pivot point.

7. The cabinet of claim 6 wherein said first, second, and third pivot points are arranged in a triangular configuration.

8. The cabinet of claim 7 wherein said urging means includes a spring having one end rigidly connected in fixed relationship to said base and another end connected to said third point, whereby said spring is increasingly deformed as said pivot plate rotates when said shelf is moved from said raised, level position to said retracted position.

9. The cabinet of claim 8 wherein said spring bias means includes a coil spring having one end connected to the third point of said pivot plate and another end anchored to said base means.

10. The cabinet of claim 9 wherein said coil spring is adjusted to have spring tension sufficient to efficiently counterbalance the weights of said shelf and the typewriter during raising and lowering of said shelf.

11. The cabinet of claim 6 wherein said first connecting point is adjacent to said first sidewall, said cabinet further including a second pivot plate also having first, second and third pivot points, the first pivot point of said second pivot plate being pivotally connected to a second fixed point within the interior volume, the second fixed point being located adjacent said second sidewall, the second pivot point of said second pivot plate being connected to a second connecting point located on an end of said support shelf opposite to said first connecting point.

12. The cabinet of claim 5 wherein the lower surface of said shelf lies approximately against an inner surface of said front wall, thereby covering said knee accommodating opening in said front wall, and wherein said cabinet further includes a stationery box located near the bottom of the interior volume, said stationery box having a front door, said front door having a front surface which is aligned with the lower surface of said shelf when said front door is closed, so that said lower surface of said shelf and said front door completely cover said knee accommodating opening.

* * * * *